US009120219B1

(12) United States Patent
Liao et al.

(10) Patent No.: US 9,120,219 B1
(45) Date of Patent: Sep. 1, 2015

(54) TOOL CASE AND TOOL BOX FOR RECEIVING THE SAME

(71) Applicants: Ying-Jie Liao, Taichung (TW); You-Guo Liao, Taichung (TW)

(72) Inventors: Ying-Jie Liao, Taichung (TW); You-Guo Liao, Taichung (TW)

( * ) Notice: Subject to any disclaimer, the term of this patent is extended or adjusted under 35 U.S.C. 154(b) by 9 days.

(21) Appl. No.: 14/247,794

(22) Filed: Apr. 8, 2014

(51) Int. Cl.

| | |
|---|---|
| ***B65D 43/22*** | (2006.01) |
| ***B25H 3/02*** | (2006.01) |
| ***B25H 3/04*** | (2006.01) |
| ***B65D 43/16*** | (2006.01) |

(52) U.S. Cl.
CPC ..... *B25H 3/021* (2013.01); *B25H 3/04* (2013.01); *B65D 43/16* (2013.01)

(58) Field of Classification Search
CPC ..... B25H 3/02; B65D 43/22
USPC ..... 206/349, 372, 373, 1.5
See application file for complete search history.

(56) References Cited

U.S. PATENT DOCUMENTS

| | | | | |
|---|---|---|---|---|
| 2006/0091032 | A1* | 5/2006 | Tsai | 206/373 |
| 2010/0012538 | A1* | 1/2010 | Brunner | 206/373 |
| 2013/0240391 | A1* | 9/2013 | Lin | 206/349 |

* cited by examiner

*Primary Examiner* — Steven A. Reynolds
*Assistant Examiner* — King M Chu

(57) ABSTRACT

A tool case includes a case, a cover, and a buckle plate. The case has a bottom, a front, a rear, and two side walls. A positioning fringe is formed on an inner face of the rear wall. The cover is pivotally disposed on the case and has a combination recess near the rear wall. The combination recess has a blocking fringe and two lateral fringes. The buckle plate is slidably disposed on the two lateral fringes. The buckle plate has a abutting margin near the blocking fringe and a positioning margin near the positioning fringe. Two slots are formed on the abutting margin to define a resilient portion whose free end has buckle element to buckle to the blocking fringe. Thus, the buckle plate tends to move toward the rear wall to make the positioning fringe buckle to the positioning margin.

13 Claims, 11 Drawing Sheets

TOOL CASE AND TOOL BOX FOR RECEIVING THE SAME

BACKGROUND OF THE INVENTION

1. Field of the Invention

The present invention relates to a tool case and a tool box for receiving the tool case.

2. Description of the Prior Art

A tool case can be adapted for receiving bolts, nuts, cable ties, or other components which are small. A conventional tool case, disclosed in patent TW 1222417, has a case 21 and a cover 22. The cover 22 is pivotally disposed on the case 21 via an axle 221. An opposite end of the cover 22 has a buckle element 222 to buckle with the elastic buckle 216 to position the cover 22 on the case 21.

However, when the tool case is to be opened, one has to release the elastic buckle 216 with one hand and to open the cover 22 with another hand. That is, the cover has to be opened with two hands to be inconvenient.

SUMMARY OF THE INVENTION

The main object of the present invention is to provide a tool case which is able to be opened with a single hand.

To achieve the above and other objects, a tool case of the present invention, includes a case, a cover, and a buckle plate.

The case includes a bottom wall, a front wall, a rear wall, and two side walls. The front wall, the rear wall, and the two side walls surround the bottom wall. A positioning fringe is formed on an inner face of the rear wall.

The cover is pivotally disposed on the case to be located above the case. The cover is pivotable with respect to an upper end of the front wall. The cover has a combination recess near the rear wall of the case. The combination recess has a blocking fringe and two lateral fringes located at two sides of the blocking fringe.

The buckle plate is received in the combination recess and is slidably connected to the two lateral fringes. The buckle plate has an abutting margin corresponding to the blocking fringe and a positioning margin corresponding to the positioning fringe. The abutting margin is formed with al least one pair of slots. A resilient portion is defined between the two slots. A buckle element is formed on a free end of the resilient portion. The buckle element is protruded toward the blocking fringe to abut against the blocking fringe so that the buckle plate tends to move toward the rear wall of the case to make the positioning margin be positioned to the positioning fringe.

Thereby, one can open the cover by pressing the buckle plate.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
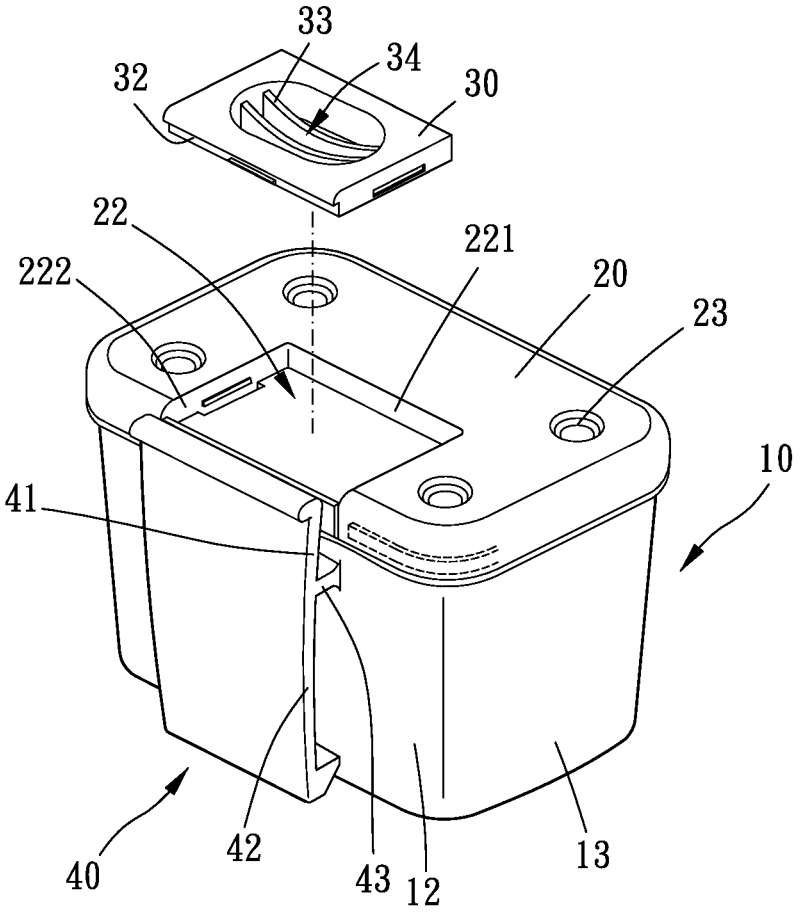
FIG. 1 is a partial breakdown drawing of the tool case of the present invention when the cover is closed.
Figure 2:
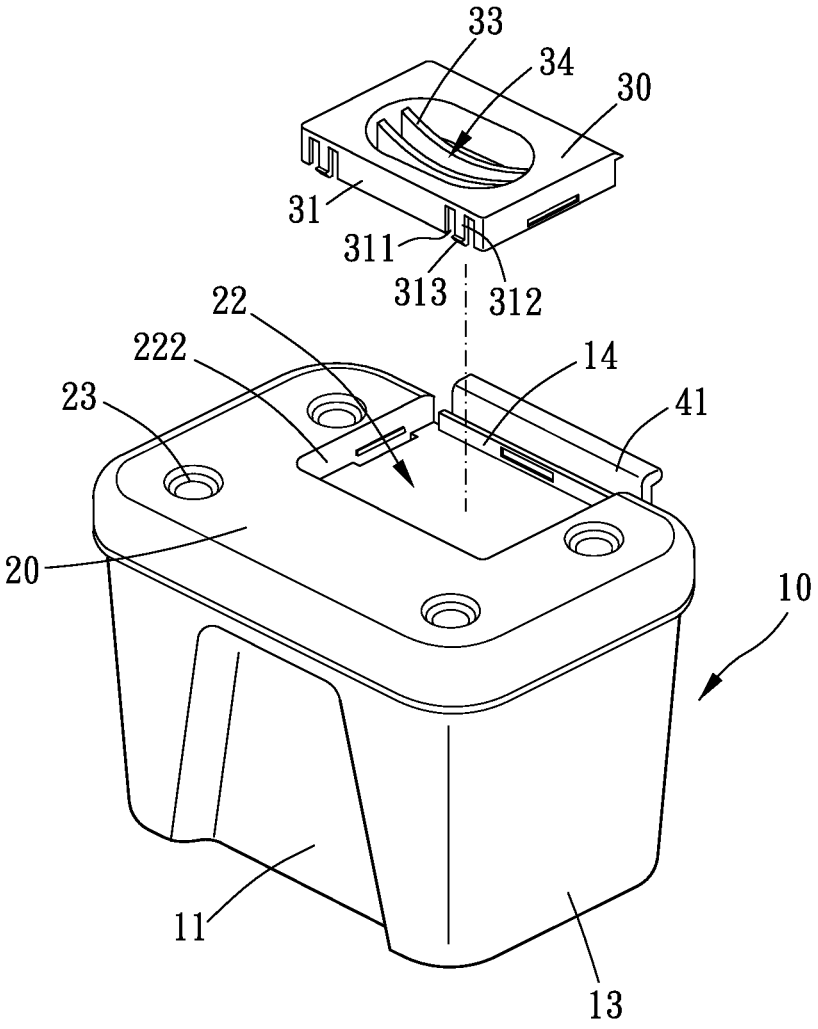
FIG. 2 is a partial breakdown drawing of the tool case of the present invention at another angle when the cover is closed.
Figure 3:
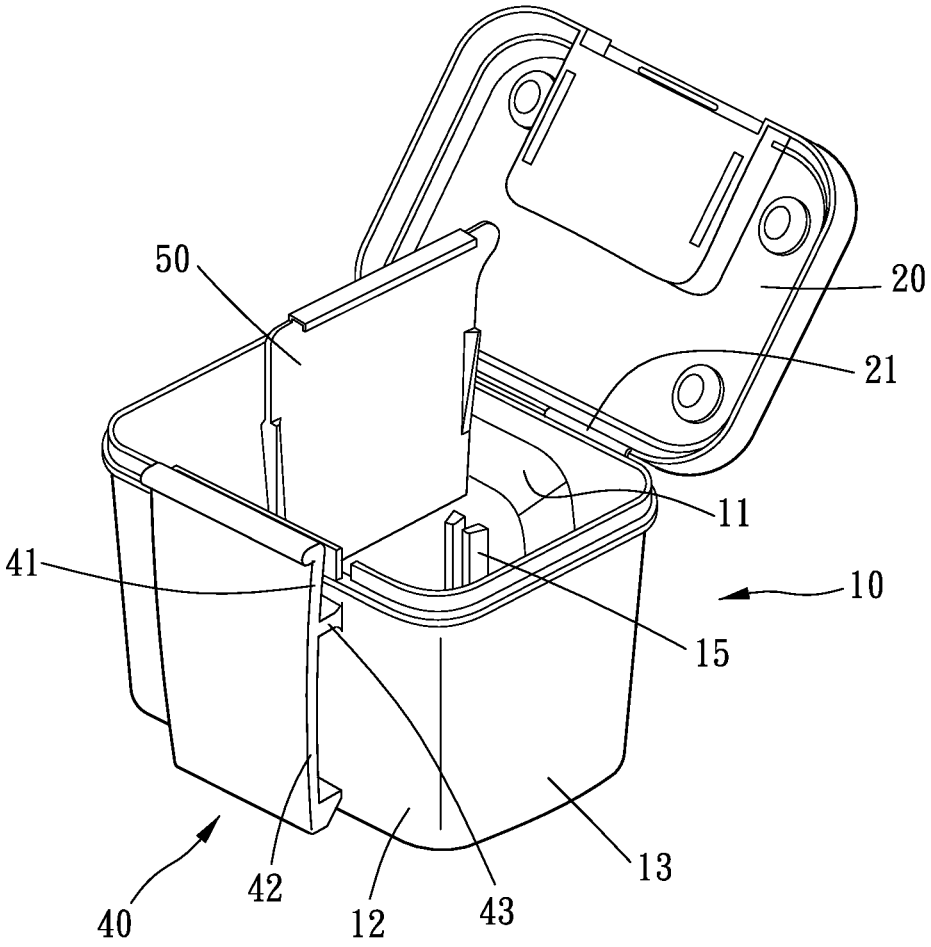
FIG. 3 is a partial breakdown drawing of the tool case of the present invention when the cover is opened.

Please refer to FIG. 1 to FIG. 3 for a first embodiment of the present invention. The tool case of the present embodiment includes a case 10, a cover 20, a buckle plate 30, a clipping plate 40, and a partitioning plate 50.

The case 10 has a bottom wall, a front wall 11, a rear wall 12, and two side walls 13. The front wall 11, the rear wall 12, and the two side walls 13 surround the bottom wall. In addition, a positioning fringe 14 is formed on an inner face of the rear wall 12.

The cover 20 is located above the case 10 and is pivotally disposed on the case 10 to be pivotable around an upper end of the front wall 11. Preferably, a resilient connecting element 21 is integrally formed between the cover 20 and the upper end 11 of the front wall 11 so as to allow the cover 20 to pivot with respect to the front wall 11. The cover 20 further has a combination recess 22 near the rear wall 12. The combination recess 22 has a blocking fringe 221 and two lateral fringes 222 located at two sides of the blocking fringe 221.

The buckle plate 30 is received in the combination recess 22 and is slidably disposed on the two lateral fringes 222. More preferably, two sides of the buckle plate 30 and the two lateral fringes 222 may have protrusions and corresponding grooves to allow the buckle plate 30 to slide in the combination recess 22. Besides, the buckle plate 30 has an abutting margin 31 near the blocking fringe 221 and a positioning margin 32 near the positioning fringe 14. That is, the abutting margin 31 is opposite to the positioning margin 32. At least two slots 311 are formed on the abutting margin 31, and a resilient portion 312 is defined between the two slots 311. The resilient portion 312 has a buckle element 313 at a free end thereof. In the present embodiment, the buckle element 313 is hook-shaped and extends toward the blocking fringe 221. The buckle element 313 abuts against the blocking fringe 221 so that the buckle plate 30 tends to move toward the rear wall 12 and to make the positioning margin 32 buckle to the positioning fringe 14 to close the case. Preferably, the positioning margin 32 and the positioning fringe 14 have protrusions and corresponding recesses to engage with each other. On the other hand, at least two pressing ribs 33 extending horizontally are formed on the top of the buckle plate 30, and a gap 34 is formed between the two pressing ribs 33. Thereby, one can move the buckle plate 30 toward the front wall 11 by pressing the pressing rib 33 to release the positioning margin 32 from the positioning fringe 14 and further pivot the cover 20. Thus, the cover 20 can be opened with a single hand.

To position the case on other objects, the clipping plate 40 is arranged outside the rear wall 12 of the case 10. More specifically, the clipping plate 40 comprises a pressing section 41, a clipping section 42, and a connecting section 43. The pressing section 41 and the clipping section 42 are connected with each other, and the connecting section 43 extends from an intermediate portion between the pressing section 41 and the clipping section 42 to connect with the outer face of the rear wall 12. The clipping plate 40 is slightly resilient, so the clipping section 42 is able to pivot around the connecting section 43 when the pressing section 41 is pressed. More preferably, an end of the clipping section 42 opposite to the pressing section 41 is hook-shaped for grasping the object which the case to be positioned on. In the present embodiment, the case 10, the cover 20, and the clipping plate 40 are formed integrally to be a single piece.

Figure 9:
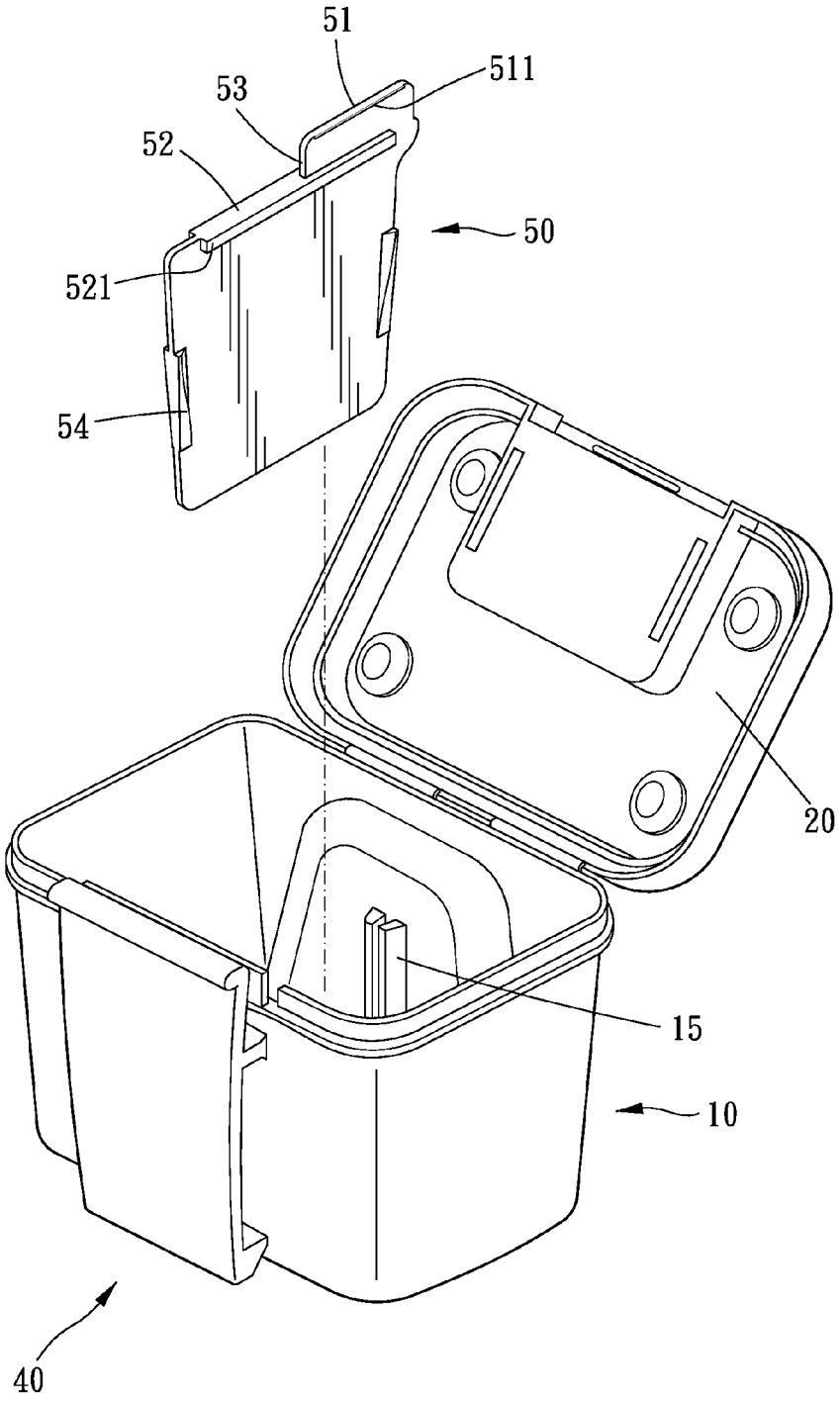
FIG. 9 is a breakdown drawing showing a third embodiment of the tool case of the present invention.
Figure 10:
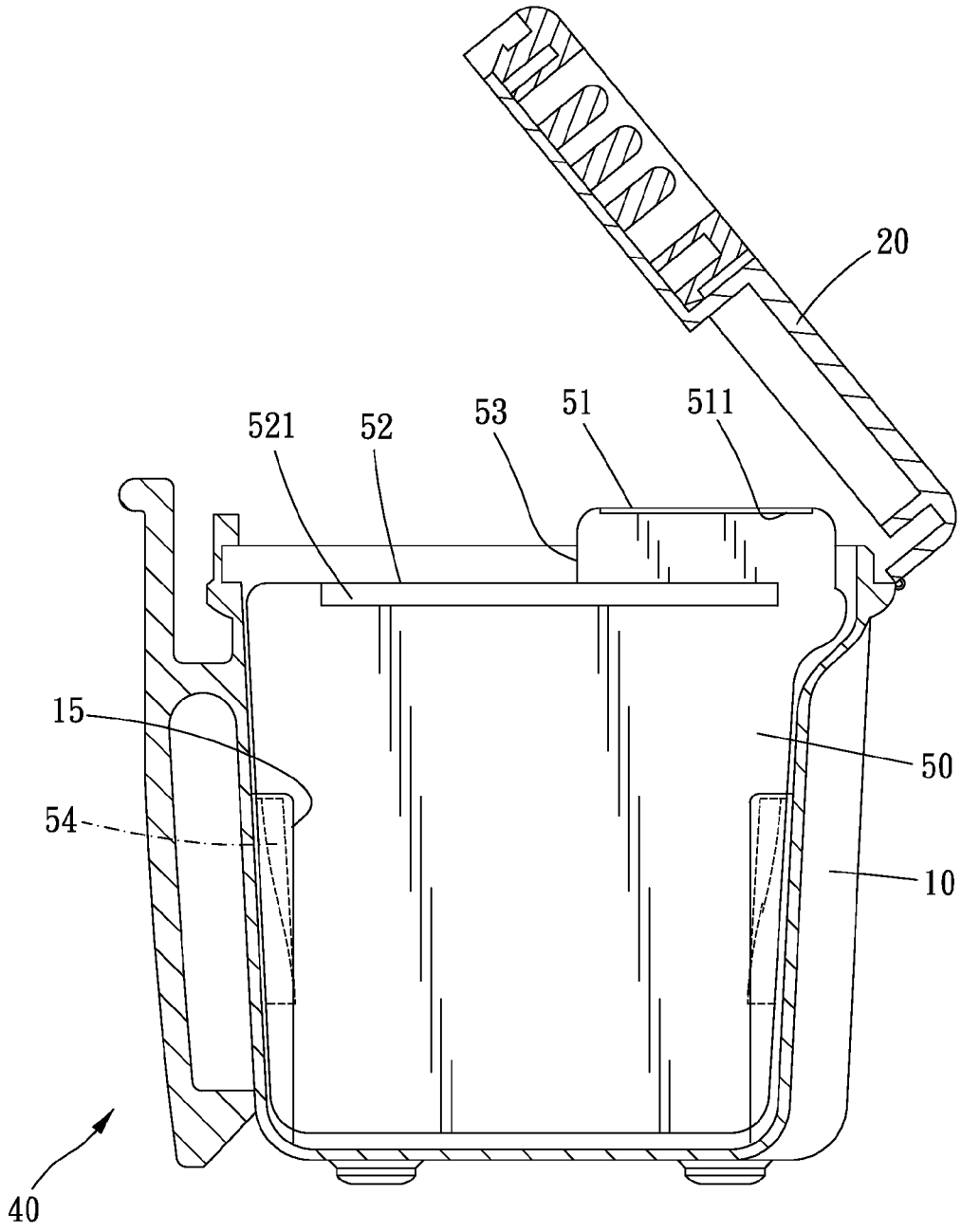
FIG. 10 is a profile showing a third embodiment of the tool case of the present invention.

To partition the tools inside the tool case, the partitioning plate 50 is positioned in the case 10 to partition it into two receiving spaces. More specifically, the inner face of each of the front wall 11 and the rear wall 12 is formed with at least two clamping plates 15. The partitioning plate 50 is detachably disposed between the two clamping plates 15 to be sandwiched therebetween. Of course, the clamping plates can be formed on the side walls alternatively. In an embodiment as disclosed in FIG. 9 and FIG. 10, the partitioning plate 50' can have a different shape from the one mentioned above. More specifically, the bottom of the cover 20 has various heights, and the top of the partitioning plate 50' corresponds to the bottom of the cover 20 to have at least two heights. Thus, tools received in the case 10 may not pass through the gap between the partitioning plate 50' and the cover 20.

More practically, the top of the partitioning plate 50' is defined with a first margin 51 and a second margin 52 from an end thereof to another end. The first margin 51 is parallel to the second margin 52, and heights of the first margin 51 and the second margin 52 vary. The first margin 51 and the second margin 52 both extend horizontally. Preferably, the first margin 51 is higher than the second margin 52. A third margin 53 is defined between the first margin 51 and the second margin 52. The third margin 53 is not parallel to neither the first margin 51 nor the second margin 52. Preferably, the third margin 53 is perpendicular to both the first margin 51 and the second margin 52 so that the top of the partitioning plate 50' is stair-shaped. The second margin 52 is formed with a support portion 521 extending horizontally, and the first margin 51 is also formed with a support portion 511 extending horizontally. The support portions 511,521 may increase contact area between the cover 20 and the first margin 51 or the second margin 52. Thus, the partitioning plate 50' is prevented from deformation when the cover 20 is closed.

The partitioning plate 20 further includes a positioning margin 54 for contacting the case 10. More specifically, the positioning margin 54 is detachably sandwiched by the two clipping plates 15 so that the partitioning plate 50' is positioned in the case 10.

Besides, the bottom of the bottom wall can be formed with plural buckle bumps or buckle notches, and the top of the cover 20 is formed with corresponding buckle notches or buckle bumps. Thus, plural tool cases can be stacked by the connection between the buckle bumps and the buckle notches.

Figure 4:
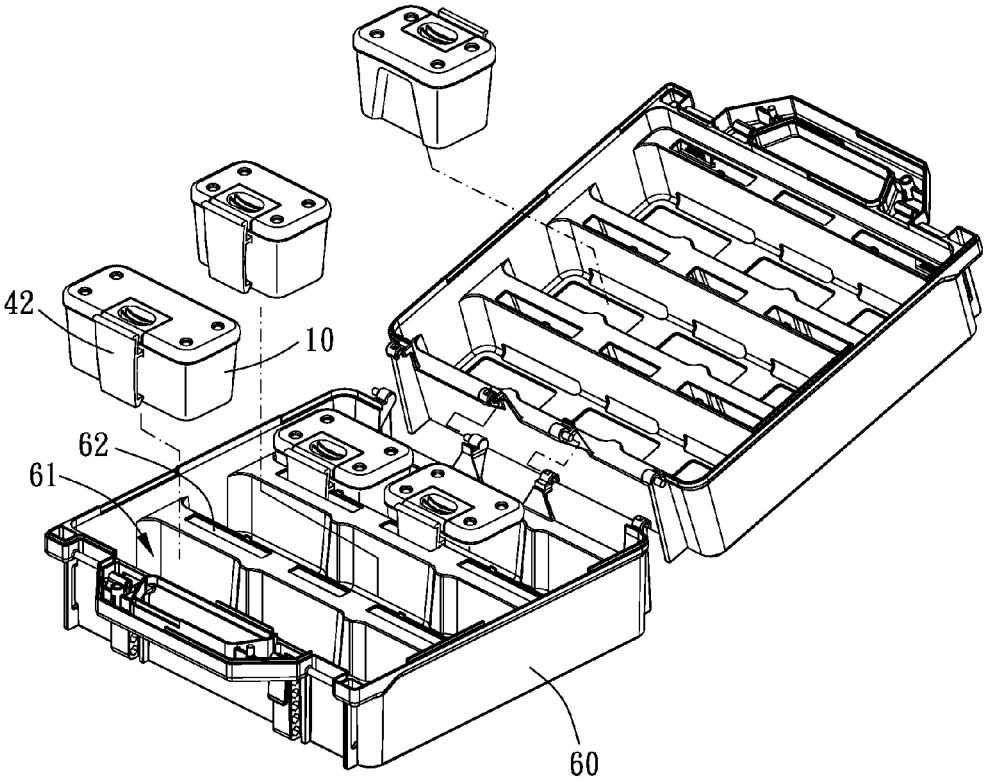
FIG. 4 is a breakdown drawing of the tool box of the present invention.
Figure 5:
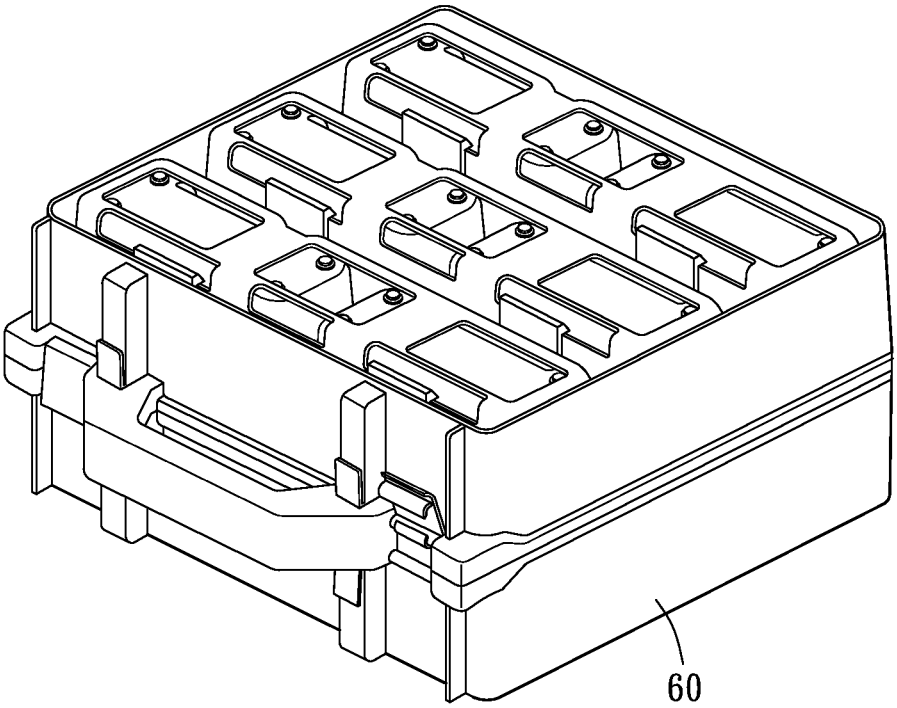
FIG. 5 is a stereogram of the tool box of the present invention.
Figure 6:
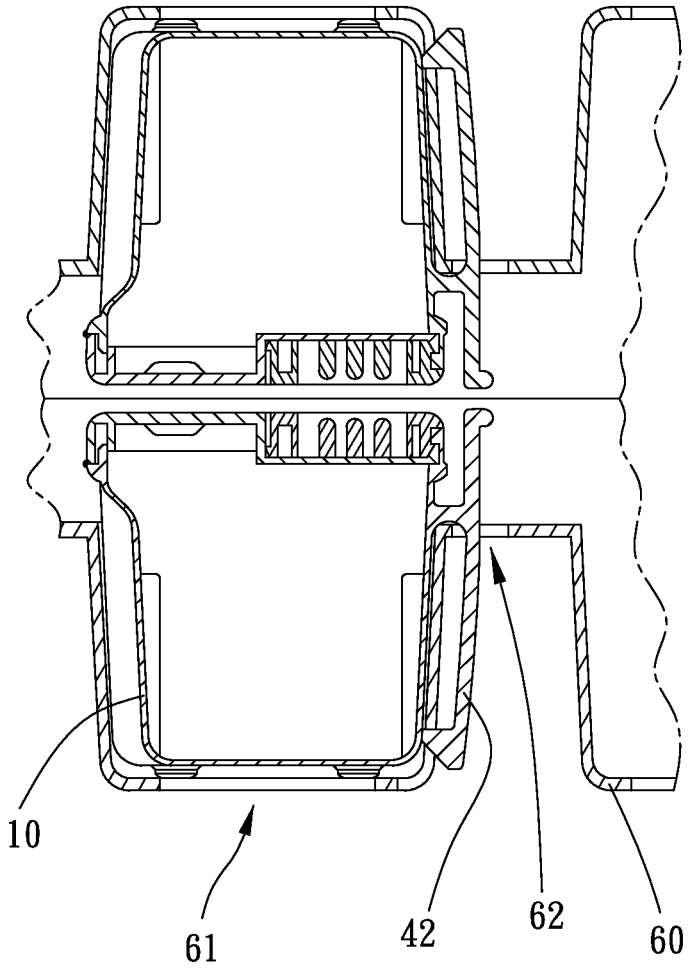
FIG. 6 is a partial profile of the tool box of the present invention.

Please refer to FIG. 4 to FIG. 6, the present invention also provides a tool box having two receiving racks 60 corresponding to each other. Preferably, the two receiving racks 60 are pivotally connected with each other. Each receiving rack 60 is formed with plural receiving recesses 61 corresponding to the case 10 and plural embed recesses 62 corresponding to the clipping section 42. The receiving recesses 61 is adapted for receiving the tool cases, and the clipping section 42 is able to be received in the embed recesses 62 to clip on the receiving rack 60 for positioning the tool case on the receiving rack 60.

Figure 7:
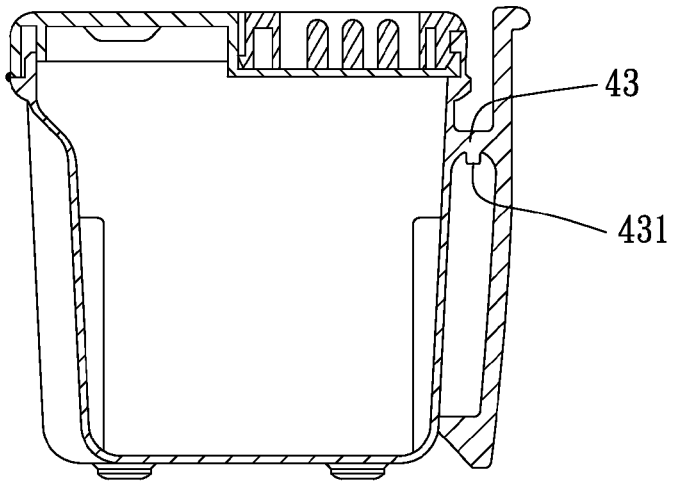
FIG. 7 is a profile showing a second embodiment of the tool case of the present invention.
Figure 8:
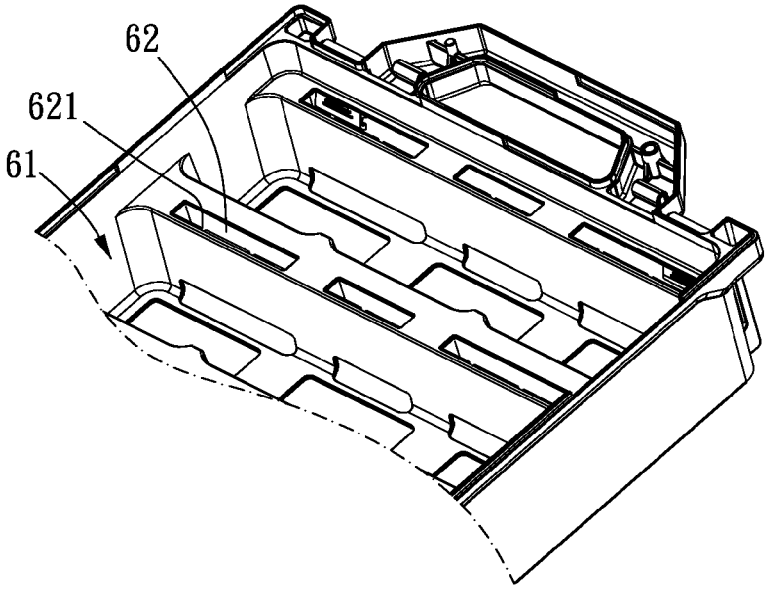
FIG. 8 is a stereogram showing a second embodiment of the tool box of the present invention.

Please refer to FIG. 7 and FIG. 8, to further position the tool case on the tool box, the connecting section 43 is formed with a protrusion 431 on the bottom thereof, and the embed recess 62 is formed with a positioning groove 621 for receiving the protrusion 431 so that the tool case is prevented from sliding in the receiving recess 61.

Figure 11:
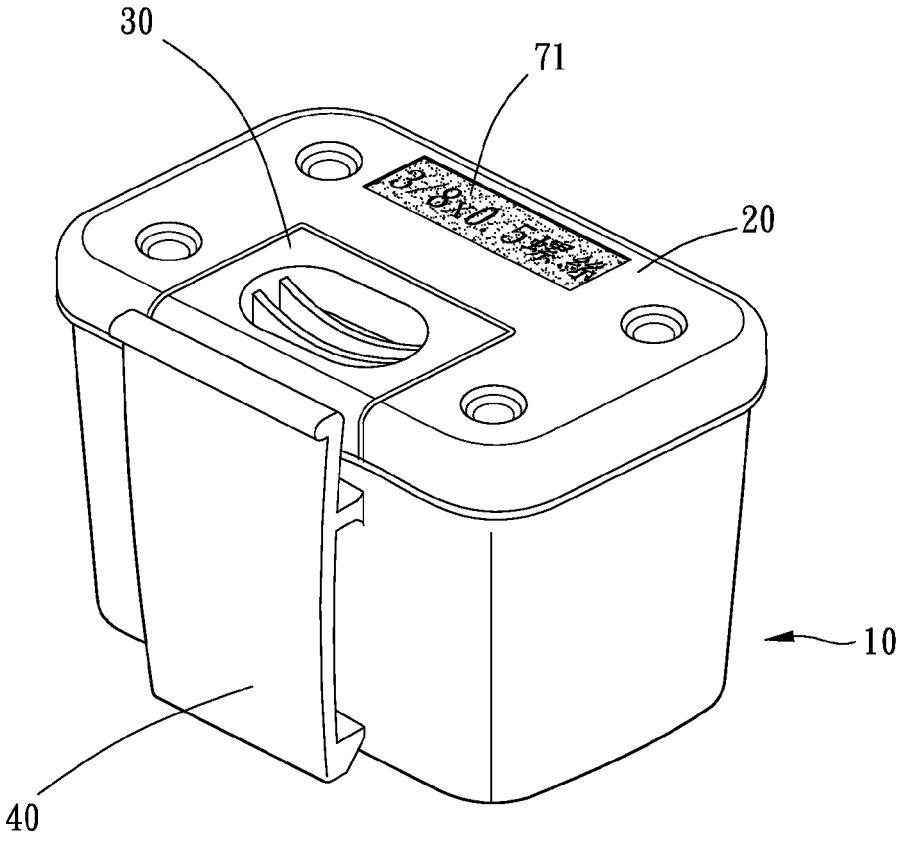
FIG. 11 is a stereogram showing a fourth embodiment of the tool case of the present invention when the cover is closed.
Figure 12:
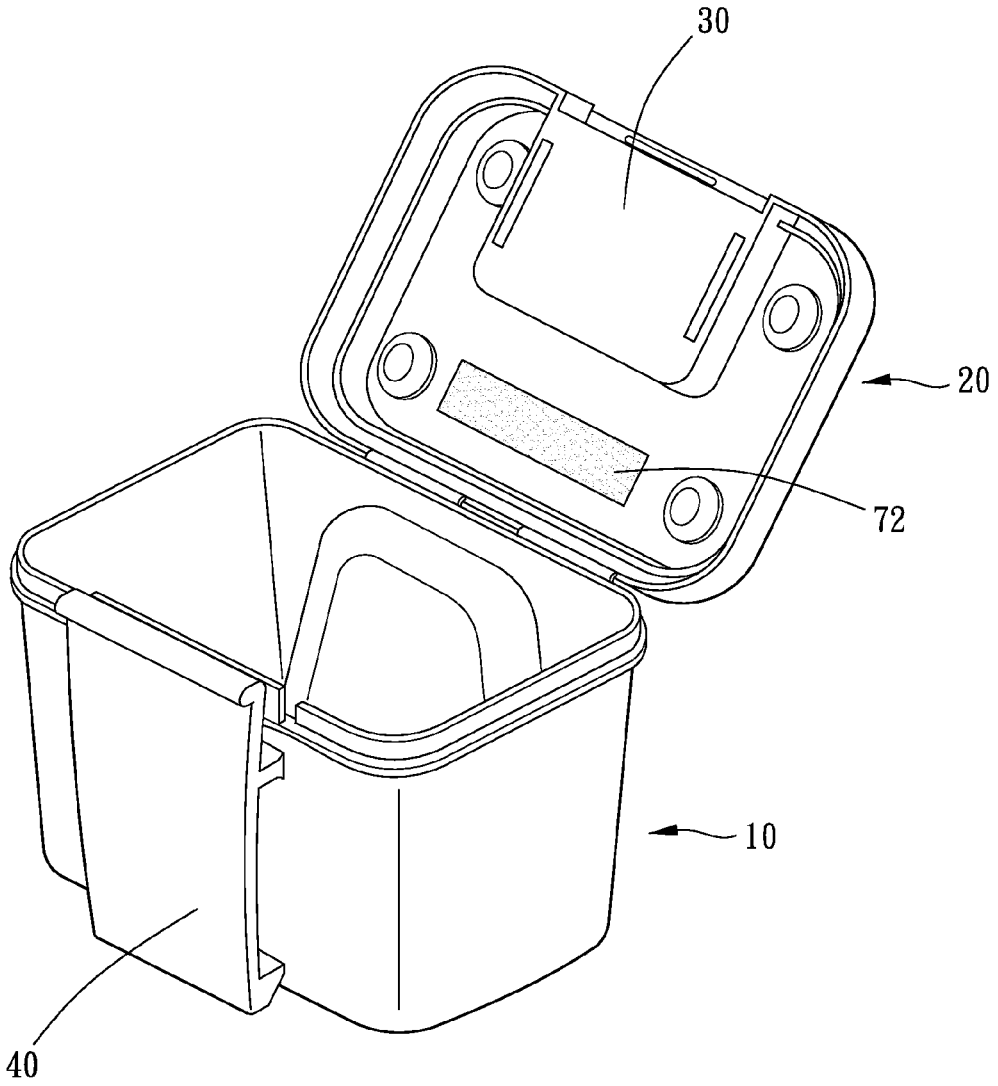
FIG. 12 is a stereogram showing a fourth embodiment of the tool case of the present invention when the cover is opened.

In another embodiment of the present invention, as shown in FIG. 11 and FIG. 12, the tool case further includes a first indicating portion 71 and a second indicating portion 72. The first indicating portion 71 is recessedly formed on the top of the cover 20, and the second indicating portion 72 is formed on a portion of the bottom of the cover 20 corresponding to the first indicating portion 71. Preferably, the second indicating portion 72 is a flat surface. Thereby, the first indicating portion 71 is adapted for a tag or a label to adhere onto, and the tag or the label may not protrude above the top of the cover 20. Thus, the tag or the label is prevented from being accidentally peeled off. Besides, no matter the cover 20 is opened or closed, a user can be informed with the information on the label due to the first indicating portion 71 or the second indicating portion 72.

What is claimed is:

1. A tool case, including:

a case, including a bottom wall, a front wall, a rear wall, and two side walls, the front wall, the rear wall, and the two side walls surrounding the bottom wall, a positioning fringe being formed on an inner face of the rear wall;

a cover, pivotally disposed on the case to be located above the case, the cover being pivotable with respect to an upper end of the front wall, the cover having a combination recess near the rear wall of the case, the combination recess having a blocking fringe and two lateral fringes located at two sides of the blocking fringe;

a buckle plate, received in the combination recess and slidably connected to the two lateral fringes, the buckle plate having an abutting margin corresponding to the blocking fringe and a positioning margin corresponding to the positioning fringe, the abutting margin being formed with al least one pair of slots, a resilient portion being defined between the two slots, a buckle element being formed on a free end of the resilient portion, the buckle element being protruded toward the blocking fringe to abut against the blocking fringe so that the buckle plate tends to move toward the rear wall of the case to make the positioning margin be positioned to the positioning fringe.

2. The tool case of claim 1, wherein the at least one resilient connecting element is arranged between the cover and the upper end of the front wall of the case so that the cover is pivotable with respect to the front wall.

3. The tool case of claim 1, wherein at least two pressing ribs extending horizontally are formed on a top of the buckle plate, a gap is formed between the two pressing ribs.

4. The tool case of claim 1, wherein plural buckle notches or buckle bumps are formed on the bottom of the bottom wall, plural corresponding buckle bumps or buckle notches are formed on a top of the cover, the buckle bumps and the buckle notches are adapted for being assembled with an other tool case.

5. The tool case of claim 1, wherein at least one pair of clamping plates are formed on an inner face of each of the front wall and the rear wall, a partitioning plate is detachably arranged between the two clamping plates to be clamped by the pair of the clamping plates.

6. The tool case of claim 5, wherein a bottom of the cover has various heights, a top of the partitioning plate has a shape corresponding to the bottom of the cover to have various heights.

7. The tool case of claim 6, wherein the top of the partitioning plate is defined with a first margin, a second margin, and a third margin between the first margin and the second margin, the first margin is higher than the second margin, a support portion is formed and extends from the first margin horizontally, a support portion is formed and extends from the second margin horizontally.

8. The tool case of claim 7, wherein the partitioning plate has a positioning margin detachably sandwiched between the pair of the clamping plates.

9. The tool case of claim 1, further including a clipping plate having a pressing section, a clipping section, and a connecting section, the connecting section further extends to connect to an outer face of the rear wall, the pressing section is adapted for being pressed to allow the clipping section to pivot.

10. The tool case of claim 1, further including a first indicating portion and a second indicating portion, the first indicating portion being recessedly formed on the top of the cover, the second indicating portion being formed on a portion of the bottom of the cover corresponding to the first indicating portion.

11. The tool case of claim 10, wherein the second indicating portion is a flat surface relative to the bottom of the cover.

12. A tool box, for receiving the tool case of claim 1, including two receiving racks which correspond to each other, at lease one receiving recess which corresponds to the case of the tool case being formed on each receiving rack so as to receive the tool case.

13. A tool box, for receiving a tool case of claim 9, including two receiving racks which correspond to each other, at lease one receiving recess which corresponds to the case of the tool case and at least one embed recess which corresponds to the clipping section of the clipping plate of the tool case being formed on each receiving rack, the clipping section is received in the embed recess.

* * * * *